US007749673B2

(12) United States Patent
Zhou et al.

(10) Patent No.: US 7,749,673 B2
(45) Date of Patent: Jul. 6, 2010

(54) TONER PROCESSES

(75) Inventors: Ke Zhou, Mississauga (CA); Guerino G. Sacripante, Oakville (CA); Karen A. Moffat, Brantford (CA); Michael S. Hawkins, Cambridge (CA); Paul J. Gerroir, Oakville (CA); Richard P. N. Veregin, Mississauga (CA)

(73) Assignee: Xerox Corporation, Stamford, CT (US)

( * ) Notice: Subject to any disclaimer, the term of this patent is extended or adjusted under 35 U.S.C. 154(b) by 765 days.

(21) Appl. No.: 11/729,748

(22) Filed: Mar. 29, 2007

(65) Prior Publication Data

US 2008/0236446 A1 Oct. 2, 2008

(51) Int. Cl.
*G03G 5/00* (2006.01)

(52) U.S. Cl. ..... 430/137.14

(58) Field of Classification Search ..... 430/137.14
See application file for complete search history.

(56) References Cited

U.S. PATENT DOCUMENTS

| | | | |
|---|---|---|---|
| 4,952,477 | A | 8/1990 | Fuller et al. |
| 5,057,392 | A | 10/1991 | McCabe et al. |
| 5,147,747 | A | 9/1992 | Wilson et al. |
| 5,166,026 | A | 11/1992 | Fuller et al. |
| 5,916,725 | A | 6/1999 | Patel et al. |
| 6,120,967 | A | 9/2000 | Hopper et al. |
| 6,383,705 | B2 | 5/2002 | Aoki et al. |
| 6,413,691 | B2 | 7/2002 | Daimon et al. |
| 6,780,557 | B2 | 8/2004 | Kawaji et al. |
| 6,830,860 | B2 | 12/2004 | Sacripante et al. |
| 6,890,695 | B2 | 5/2005 | Shirai et al. |
| 6,942,951 | B2 | 9/2005 | Daimon et al. |
| 7,056,635 | B2 | 6/2006 | Tanaka et al. |
| 7,115,350 | B2 | 10/2006 | Jung |
| 2006/0204880 | A1 | 9/2006 | Mizutani et al. |

OTHER PUBLICATIONS

Guerino G. Sacripante et al., U.S. Appl. No. 11/556,926 on Emulsion Aggregation Polyester Toners, filed Nov. 6, 2006.
Guerino G. Sacripante et al., U.S. Appl. No. 11/676,080 on Curable Toner Compositions and Processes, filed Feb. 16, 2007.
Enno E. Agur et al., U.S. Appl. No. 11/549,249 on Emulsion Aggregation Processes, filed Oct. 13, 2006.

*Primary Examiner*—Mark A Chapman
(74) *Attorney, Agent, or Firm*—Carter, DeLuca, Farrell & Schmidt, LLP

(57) ABSTRACT

A toner process comprising the aggregation and coalescence of an amorphous polyester, a crystalline polyester and a colorant, and wherein the coalescence is conducted at a temperature that is about lower than the melting point temperature of the crystalline polyester.

32 Claims, No Drawings

TONER PROCESSES

RELATED PATENTS

In copending U.S. patent application Ser. No. 11/556,926, filed Nov. 6, 2006, the disclosure of which is totally incorporated herein by reference, there is disclosed an emulsion aggregation polyester toner comprised of an amorphous resin and a crystalline resin, wherein the toner has an acid value of from about 16 mg/eq. KOH to about 40 mg/eq. KOH, wherein the toner has a melting point of from about 50° C. to about 130° C., and wherein in embodiments the toner process includes a latex generated from an emulsion of a polyester resin having an acid value of from about 16 mg/eq. KOH to about 40 mg/eq. KOH, dissolving the polyester resin in an organic solvent, neutralizing the acid groups with an alkali base, dispersing in water followed by heating to remove the organic solvent, and optionally adding to the emulsion a colorant dispersion and/or a wax dispersion, shearing and adding an aqueous solution of acid until the pH of the mixture is from about 3 to about 5.5, heating to a temperature of from about 30° C. to 60° C., wherein the aggregates grow to a size of from about 3 to about 20 microns, raising the pH of the mixture to from about 7 to about 9, heating the mixture to about 60° C. to about 95° C., and optionally decreasing the pH to a range of 6.0 to 6.8 to coalesce the particles.

In copending U.S. patent application Ser. No. 11/676,080, filed Feb. 16, 2007, the disclosure of which is totally incorporated herein by reference, there are disclosed curable toner compositions, such as those prepared by a chemical process such as emulsion aggregation, wherein the resultant toner composition comprises an unsaturated polyester resin, a photoinitiator, optionally a wax, and optionally a colorant. In an embodiment, the disclosure provides a toner process comprising an emulsion aggregation process comprising (i) emulsification of an unsaturated amorphous, and/or crystalline polyester resin with an optional photoinitiator;

(ii) adding thereto a colorant dispersion, optionally a photoinitiator dispersion, optionally a wax dispersion and a surfactant;

(iii) adding thereto a coagulant such as an acid, metal halide, or metal sulfate with homogenization of from about 2,000 to about 10,000 rpm, and optionally adjusting the pH of mixture to from about 7 to about 2.5, and thereby generating aggregated composites of from about 1 to about 4 microns in diameter;

(iv) heating the aggregate mixture to a temperature of from about 30° C. to about 50° C. to generate an aggregate composite with a particle size of from about 3 to about 11 microns in diameter;

(v) adjusting the pH to about 6 to about 9 to freeze the toner composite particle size, and optionally adding a metal sequestering agent such as an ethylenediamine tetra sodium salt;

(vi) heating the aggregate composite to a temperature of from about 60° C. to about 90° C., and optionally adjusting the pH to about 8 to about 5.5 to result in coalesced toner particles;

(vii) washing, and drying the toner particles.

In copending U.S. patent application Ser. No. 11/549,249, filed Oct. 13, 2006, the disclosure of which is totally incorporated herein by reference, there is disclosed a process for preparing a toner comprising:

solvent flashing wax and resin together to emulsify the resin and wax to a submicron size;

mixing the wax and resin emulsion with a colorant, and optionally a coagulant to form a mixture;

heating the mixture at a temperature below a glass transition temperature of said resin to aggregate said resin, colorant, and wax to form aggregated particles;

heating the aggregated particles and coalescent agent at a temperature above the glass transition temperature of said resin, to coalesce said aggregated particles to form toner particles;

optionally cooling the mixture; and isolating the toner particles.

Polyester based toners can be generated from amorphous and crystalline polyester emulsions with acid numbers of, for example, from about 13 to about 15, and with a known coagulant, such as aluminum sulfate. These toners in a number of instances may have a poor resistivity and undesirable triboelectric charging at certain relative humidities, mainly due, it is believed, to the crystalline resin component migrating to the toner composition surface during coalescence at a temperature at about the melting point or above the melting point of the crystalline resin. The more conductive crystalline resin on the toner surface is believed to be responsible for the poor toner electrical performance.

These and other disadvantages are substantially avoided with the toners and processes illustrated herein with these toner processes being particularly beneficial for non-sulfonated polyester resin based toner, and wherein the toner process comprises the aggregation and coalescence of an amorphous polyester, a crystalline polyester and a colorant, and wherein the coalescence is conducted at a temperature that is lower than the melting point temperature of the crystalline polyester resulting in toners which exhibit low fixing temperatures, a broad fusing latitude of, for example, from about 50° C. to about 90° C., excellent print quality, when such toners are selected for xerographic image development high gloss, and stable xerographic charging in ambient environments, and with excellent heat cohesion.

BACKGROUND

The present disclosure is generally directed to toner processes, and more specifically, to the aggregation and coalescence of an aqueous suspension of colorant, such as pigment particles, wax particles and resin particles, utilizing a coagulant to afford toner composites of various suitable sizes, such as for example, from about 1 to about 15, and preferably from about 3 to about 11. More specifically, disclosed in embodiments is the preparation of an ultra low melt polyester based chemical toners, comprised of a colorant, optionally a wax, an amorphous resin and a crystalline resin, and wherein the process allows for minimal or no plasticization of the amorphous and crystalline resin such that excellent heat cohesion or blocking, such as from about 52° C. to about 60° C., is obtained, and excellent tribocharge, charge maintainability, and relative humidity (RH) sensitivity results, where the low melt or ultra low melt fixing temperature is, for example, from about 100° C. to about 130° C. Further, disclosed is a toner process comprising the aggregation and coalescence of an amorphous polyester, a crystalline polyester and a colorant, and wherein the coalescence is conducted at a temperature that is lower than the melting point temperature of the crystalline polyester, resulting in toners that are low melting with excellent resistivity, low melting characteristics, and where migration of the crystalline polyester to the toner surface is substantially avoided or minimized, and in embodiments a narrow GSD of, for example, from about 1.16 to about 1.26, or about 1.18 to about 1.28, as measured on the Coulter Counter, can be obtained. The toner process disclosed in embodiments enables the utilization of polymers such as polyesters obtained by polycondensation reactions. The resulting toners can be selected for known electrophotographic imaging methods, printing processes, including color processes, digital methods, and lithography.

Also included within the scope of the present disclosure are methods of imaging and printing with the toners illustrated herein. These methods generally involve the formation of an electrostatic latent image on an imaging member, followed by developing the image with a toner composition comprised, for example, of thermoplastic resin, colorant, such as pigment, wax, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein toner is to be used in a printing mode, the imaging method involves the same operation with the exception that exposure can be accomplished with a laser device or image bar. More specifically, the emulsion aggregation coalescent toners disclosed herein can be selected for the Xerox Corporation iGEN® machines that generate with some versions over 100 copies per minute. Processes of imaging, especially xerographic imaging and printing, including digital, and/or color printing, are thus encompassed by the present disclosure. Moreover, the toners of this disclosure are useful in color xerographic applications, particularly high-speed color copying and printing processes.

Emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,370,963, 5,344,738, 5,403,693, 5,418,108, 5,364,729, and U.S. Pat. No. 5,346,797. Also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,910,387; 5,919,595; 5,916,725; 5,902,710; 5,863,698, 5,925,488; 5,977,210 and 5,858,601. The appropriate processes and components of these patents may be selected for the present disclosure in embodiments thereof.

Two main types of emulsion aggregation (or EA) toners are known, reference for example a number of the Xerox Corporation emulsion aggregation U.S. patents recited herein, and more specifically, U.S. Pat. No. 6,120,967, the disclosure of which is totally incorporated herein by reference, and U.S. Pat. No. 5,916,725, the disclosure of which is totally incorporated herein by reference.

Emulsion aggregation techniques typically involve the formation of an emulsion latex of the resin particles, which particles have a small size of from, for example, about 5 to about 500 nanometers in diameter, by heating the resin, optionally with solvent if needed, in water, or by preparing a latex in water. A colorant dispersion, for example comprised of a pigment dispersed in water, optionally also with additional resin, is separately formed. The colorant dispersion is added to the emulsion latex mixture, and an aggregating agent or complexing agent is then typically added to initiate aggregation of larger size toner particles. Once the desired size toner particles are achieved, aggregation is stopped. The aggregated toner particles may then be heated to enable coalescence/fusing, thereby achieving aggregated, fused toner particles.

Low temperature fixing toners comprised of semicrystalline resins are known, such as those disclosed in U.S. Pat. No. 5,166,026, the disclosure of which is totally incorporated herein by reference, and which toners are comprised of a semicrystalline copolymer resin, such as a poly(alpha-olefin) copolymer resin, with a melting point of from about 30° C. to about 100° C., and containing functional groups comprising hydroxy, carboxy, amino, amido, ammonium or halo, and pigment particles. Similarly, in U.S. Pat. No. 4,952,477, the disclosure of which is totally incorporated herein by reference, toner compositions comprised of resin particles selected from the group consisting of a semicrystalline polyolefin and copolymers thereof with a melting point of from about 50° C. to about 100° C. and pigment particles are disclosed. In U.S. Pat. No. 6,413,691, the disclosure of which is totally incorporated herein by reference, there is illustrated a toner comprised of a binder resin and a colorant, the binder resin with a crystalline polyester containing a carboxylic acid of two or more valences having a sulfonic acid group as a monomer component, and which toners usually possess a narrow fusing latitude, and thus are inferior for contact fusing applications wherein high gloss images are desired. Furthermore, crystalline resins are typically of a low resistivity thus resulting in poor tribocharge, unacceptable charge maintainability, and high RH sensitivity.

Low fixing toners comprised of crystalline resin and amorphous polyester resin are illustrated in U.S. Pat. Nos. 5,147,747; 5,057,392; 7,115,350; 7,056,635; 6,942,951; 6,890,695; 6,383,705, and 6,780,557, the disclosures of which are totally incorporated herein by reference,.

Also, polyester based emulsion aggregation toners comprised of a crystalline and an amorphous resin are known, such as the sulfopolyester based toners of U.S. Pat. No. 6,830,860, the disclosure of which totally incorporated herein with reference. The toner and process of U.S. Pat. No. 6,830,860 are comprised of sulfonated polyester resin, and which toner can in a number of instances have a poor resistivity and undesirable triboelectric charging at certain relative humidities, mainly due to the hydrophilic nature of the sulfonated moieties.

There is thus a need for a low fixing toner, such as from about 100° C. to about 130° C., comprised of an amorphous and crystalline resin, and wherein such toner is prepared by an economical process, such as emulsion aggregation, and such that small particle sizes, such as from about 3 to about 9 microns, and more specifically, from about 4 to about 7 microns, are obtained for high resolution color applications, and wherein these toners exhibit broad fusing latitude of from about 50° C. to about 90° C., excellent print quality, high gloss, and stable xerographic charging in ambient environments for substantially all colors with a low RH sensitivity, such as from about 0.5 to about 1, and a high toner glass transition temperature, such as from about 55° C. to about 60° C. with low heat cohesion at 55° C., such as from about 1 to about 20 percent flowability.

SUMMARY

In a feature of the present disclosure there are provided chemical processes for the preparation of black and colored low melting toner compositions, such as from about 100° C. to about 130° C., and with a broad fusing latitude of from about 50° C. to about 90° C.

In yet another feature of the present disclosure there are provided toner compositions with low fusing temperatures of from about 100° C. to about 130° C. with excellent blocking characteristics at from about 50° C. to about 60° C., and excellent heat cohesion, such as from about 1 to about 20 percent cohesion, at a temperature of from about 50° C. to about 55° C.

In a further feature of the present disclosure there is provided a process for the preparation of toner compositions with an average particle volume diameter of from about 1 to about 20 microns, and a process for the preparation of toner compositions with an average particle volume diameter of from about 1 to about 20 microns, more specifically from about 1 to about 9 microns, and yet more specifically, from about 4 to about 7 microns, and with a narrow GSD of from about 1.12 to about 1.30, and more specifically, from about 1.14 to about 1.25, each as measured with a Coulter Counter.

Moreover, in further features, there are provided chemical processes for the preparation of black and colored toner compositions with, for example, high gloss such as from about 50 to about 80 gardner gloss units, high triboelectric charge, and charge maintainability of from about 85 to about 100 percent of the original charge after aging, and with low RH sensitivity such as from about 0.5 to about 1; a process for the preparation of toner compositions comprised of an amorphous resin and crystalline resin, and wherein minimal or no plasticization of the amorphous and crystalline resin occurs; and a process for the preparation of toner compositions wherein the coalescence of the toner particles is achieved at a temperature below the onset melting point of the crystalline resin, and wherein coalescence is achieved by decreasing the pH value from an initial pH, which is from about 6.5 to about 7, to a pH value of from about 5.7 to about 6.3.

Aspects of the present disclosure relate to a toner process comprising the aggregation and coalescence of an amorphous polyester, a crystalline polyester, a colorant, and wherein the coalescence is conducted at a temperature that is lower than the onset melting point temperature of the crystalline polyester; a toner process comprising the aggregation and coalescence of an amorphous polyester, a crystalline polyester, and a colorant, and wherein the coalescence is conducted at a temperature that is lower than the onset melting point temperature of the crystalline polyester, and wherein the pH is adjusted from a value of from about 6.5 to about 7 to a value of from about 5.7 to about 6.3; a toner process comprising the aggregation and coalescence of an amorphous polyester, a crystalline polyester, a colorant, toner additives, and wherein the coalescence is conducted at a temperature that is lower than the onset melting point temperature of the crystalline polyester; a toner process comprising the mixing, aggregation and coalescence of an amorphous polyester, a crystalline polyester, and a colorant, and wherein the coalescence is conducted at a temperature that is lower than the onset melting point temperature of the crystalline polyester, and wherein the pH of the mixture is adjusted from a value of from about 6.5 to about 7 to a value of from about 5.7 to about 6.3; and a process for the preparation of toner compositions comprising the mixing, aggregation and coalescence of an amorphous polyester, a crystalline polyester, a colorant, and a wax, and wherein the coalescence is conducted at a temperature that is about equal to or lees than the onset melting point temperature of the crystalline polyester; a toner process comprising the aggregation and coalescence of a mixture of a colorant, additives like a wax, an amorphous polyester, a crystalline polyester, and coagulant, and where the coalescence is accomplished below the onset melting point of the crystalline polyester, and more specifically, at a temperature of from about 63° C. to about 70° C., and yet more specifically, at an onset temperature of from less than the temperature of the crystalline component, and wherein in embodiments spheroidization of the particles can be obtained by decreasing the pH of the toner mixture below about 6.3, and more specifically, from about 6.3 to about 5.7.

Disclosed in embodiments is the preparation of an ultra low melt polyester based chemical toner comprised of a colorant, optionally a wax, an amorphous polyester resin, and a crystalline polyester resin, and wherein the process allows for minimal or no plasticization of the amorphous and crystalline resin, such that excellent heat cohesion or blocking, such as from about 52° C. to about 60° C., is obtained; a process comprised of (i) generating an emulsion of amorphous polyester resin particles with a size (volume average diameter) of from about 50 to about 250 nanometers;

(ii) generating an emulsion of crystalline polyester resin particles with a size of from about 50 to about 250 nanometers;

(iii) aggregating a mixture of the amorphous polyester resin particles, crystalline polyester resin particles, a colorant dispersion, and optionally a wax dispersion with a coagulant by adjusting the pH of the mixture to from about 2.5 to about 4 with s dilute acid, such as nitric or hydrochloric acid, and shearing the mixture with an homogenizer operating at a speed of from about 2,000 to about 10,000 rpm;

(iv) heating the resulting mixture to a temperature of from about 40° C. to about 53° C. to thereby generate a composite toner aggregate of from about 3 to about 9 microns in diameter;

(v) freezing the composite size utilizing an alkaline base, such as sodium hydroxide or ammonium, to achieve a pH of from about 6.3 to about 9, and optionally adding a metal sequestering agent such as ethylenediamine-tetraacetic acid (tetra sodium salt);

(v) heating the aggregate composite to a temperature below the onset melting point of the crystalline resin;

(vii) decreasing the pH of the mixture of from about 5.7 to about 6.3 with acid or buffer to coalesce the composite;

(viii) cooling, washing and drying of the toner product.

The amorphous and crystalline polyesters selected can include a number of known polyester resins with acidic end groups, branched amorphous polyester resins and unsaturated polyester resins, and more specifically, nonsulfonated polyester resins.

The disclosed toner process comprises the generation of polyester emulsion resin particles, which can be obtained by known solvent flash or phase inversion techniques. In the solvent flash process, the amorphous or crystalline polyester can exhibit acid numbers of from about 5 to about 30 meq/KOH, and more specifically, from about 10 to about 20 meq/KOH. The polyester resins are dissolved in a low boiling organic solvent, which is immiscible with water, such as ethyl acetate or methyl ethyl ketone (MEK), at a concentration of from about 1 to about 15 weight percent of resin in solvent. The dissolution of the crystalline or amorphous polyester resin can be aided by heating the mixture at from about 40° C. to about 75° C. The organic solution comprised of the dissolved resin is then added to an aqueous solution comprised of an alkaline base, such as sodium hydroxide or ammonia, with homogenization at from about 1,000 to about 10,000 revolutions per minute for a suitable duration, such as from about 1 minute to about 30 minutes, followed by distillation with stirring of the organic solvent to afford the resin emulsion particles with an average diameter size of, for example, from about 50 to about 250 nanometers, and more specifically, from about 120 to about 180 nanometers. Optionally, anionic surfactants, such as sodium dodecylbenzene sulfonate, sodium dodecylnaphthalene sulfate, dialkyl benzenealkyl sulfates, can be added to, for example, control the resin particle size.

In the phase inversion process, the amorphous or crystalline polyester resin is dissolved in a low boiling, about 30° C. to about 85° C., organic solvent, and which solvent is immiscible in water, such as a solvent of ethyl acetate or ethyl methyl ketone, at a concentration of from about 10 to about 60 percent by weight of resin in solvent, followed by heating to a temperature of about 25° C. to about 70° C., and adding thereto a solvent inversion agent, such as an alcohol like isopropanol, in a concentration of from about 10 to about 30 weight percent of the resin, followed by the dropwise addition of an alkaline base, such as ammonia, and water until phase inversion occurs (oil in water), followed by distillation with stirring of the organic solvent to afford the resin emulsion particles with an average diameter size of, for example, from about 50 to about 250 nanometers, and more specifically, from about 120 to about 180 nanometers.

Subsequent to generating both the amorphous and crystalline resin particle emulsions, these components are mixed with a colorant dispersion, optionally an anionic surfactant and optionally a wax emulsion. The mixture of components are present in an amount of from about 5 to about 25 weight percent of crystalline resin, about 60 to about 90 weight percent of amorphous resin, about 3 to about 15 weight percent of colorant, and optionally from about 5 to about 15 percent by weight of a wax dispersion, and wherein the total weight percent of all component is 100 percent by weight of the toner. The amount of optional anionic surfactant utilized is from about 0 to about 3 weight percent of the toner, but not included in the total weight percent of the toner since the surfactant is usually eventually removed from the toner composite by washing.

The aggregation of the mixture is then accomplished by adjusting the pH of the mixture to from about 2.5 to about 4 by the addition of a dilute solution of acid in water, such as nitric acid, or hydrochloric acid in a concentration of from about 0.1 to about 1 Normal. During the acid addition, especially when no surfactants are present, the mixture is homogenized at from about 1,000 to about 5,000 revolutions per minute resulting in the aggregation of the resin emulsion particles with colorant and the wax to form a composite aggregate of from about 1 to about 4 microns in diameter. When an anionic surfactant is utilized, such as sodium dodecylbenzene sulfonate, in an amount of, for example, from about 1 to about 3 weight percent of the toner, a multivalent coagulant, such as aluminum sulfate or polyaluminum chloride, is added with homogenization at a concentration of from about 0.1 to about 0.5 part per hundred to form a composite aggregate of from about 1 to about 4 microns in diameter.

The phase inversion process in embodiments involves forming the resin emulsion particles by dissolving the polyester resin in an organic solvent, adding thereto a phase inversion agent, and neutralizing the acid groups of the polyester resin with an alkali base, followed by adding water thereto dropwise until a phase inversion occurs (oil in water) and heating to remove the organic solvent, thereby resulting in a latex emulsion. Desirably, the emulsion includes seed particulates of the polyester possessing an average size of, for example, from about 10 to about 500 nanometers, such as from about 10 nanometers to about 400 nanometers, or preferably from about 50 nanometers to about 250 nanometers.

In embodiments of the phase inversion process any suitable organic solvent may be used to dissolve the polyester resin, for example, including alcohols, esters, ethers, ketones, and amines, such as ethyl acetate, in an amount of, for example, from about 20 weight percent to about 60 weight percent resin weight, and any phase inversion agent, such as an organic alcohol like methanol, ethanol, propanol, isopropanol, butanol, and the like can be utilized in an amount of, for example, about 5 weight percent to about 30 weight percent resin to solvent weight. Also, the process involves optionally adding a surfactant to the emulsion in an amount of, for example, about 0.5 percent to about 3 percent. Anionic surfactants can be utilized, but can be replaced or added in combination with nonionic or cationic surfactants. Anionic surfactants can include, for example, sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN RK™, NEOGEN SC™ available from Kao, and the like.

Examples of cationic surfactants can include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C12, C15, C17 trimethyl ammonium bromides, halide salts of quaternized polyoxyethylalkylamines, dodecyl benzyl triethyl ammonium chloride, MIRAPOL™, and ALKAQUAT™ available from Alkaril Chemical Company, SANISOL™ (benzalkonium chloride), available from Kao Chemicals, and the like. An example of a preferred cationic surfactant is SANISOL™ B-50 available from Kao Corporation, which comprises primarily benzyl dimethyl alkonium chloride.

Examples of nonionic surfactants may include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol, available from Rhodia as IGEPAL™ CA-210, IGEPAL™ CA-520, IGEPAL™ CA-720, IGEPAL™ CO 890, IGEPAL™ CO-720, IGEPAL™ CO-290, IGEPAL™ CA-210, ANTAROX™ 890, and ANTAROX™ 897.

The aggregate composite comprised of the amorphous resin, crystalline resin, colorant, and optionally a wax is then grown to a desired particle size, such as from about 4 to about 15 microns, by heating the formed toner aggregates to a temperature of from about 35° C. to about 51° C. After the desired particle size is reached, the composite can be stabilized from further growth, known as "freezing", by adjusting the pH of the mixture to about 6.5 to about 9 by the addition of an alkaline base such as sodium hydroxide or ammonia. When a metal coagulant is utilized, then it can be sequestered from the toner composite by adding to the mixture an ethylenediamine-tetraacetic acid (sodium salts).

After the formation of the stabilized toner composite aggregates, the mixture is heated, to coalesce the particles, to a temperature of from about 63° C. to about 75° C., and the pH is lowered to about 6.3 or less, such as to about 6 or to about 5.9. It is desirable to coalesce the particle composite at a temperature of less than about the onset melting point of the crystalline resin such that the crystalline resin does not plasticize the amorphous resin polyester, for example to obtain toner particles which possess excellent heat cohesion properties. The resulting toner product is then cooled, washed, and dried.

In embodiments, the amorphous polyester may be, for example poly(1,2-propylene-diethylene)terephthalate, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), or poly(1,2-propylene itaconate). The amorphous polyester resin may also be crosslinked or branched to, for example, assist in the achievement of a broad fusing latitude, or when black or matte prints are desired.

The amorphous linear or branched polyester resins, which are available from a number of sources, are generally prepared by the polycondensation of an organic diol, a diacid or diester, and a multivalent polyacid or polyol as the branching agent and a polycondensation catalyst.

Examples of diacid or diesters selected for the preparation of amorphous polyesters include dicarboxylic acids or diesters selected from the group consisting of terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, in an amount of from about 45 to about 52 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and mixtures thereof. The amount of organic diol selected can vary, and more specifically, is, for example, from about 45 to about 52 mole percent of the amorphous polyester resin.

Branching agents to generate a branched amorphous polyester resin include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, 1,2,7,8-octanetetracarboxylic acid, and acid anhydrides thereof, and lower alkyl esters thereof; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethyl benzene, mixtures thereof, and the like. The branching agent amount selected is, for example, from about 0.1 to about 5 mole percent of the resin.

The amorphous resin may be, for example, present in an amount of from about 50 to about 90 percent by weight, and, for example, from about 65 to about 85 percent by weight of the toner, which resin may be a branched or linear amorphous polyester resin where amorphous resin can possess, for example, a number average molecular weight ($M_n$), as measured by gel permeation chromatography (GPC), of from about 10,000 to about 500,000, and more specifically, for example, from about 5,000 to about 250,000, a weight average molecular weight ($M_w$) of, for example, from about 20,000 to about 600,000, and more specifically, for example, from about 7,000 to about 300,000, as determined by GPC using polystyrene standards; and wherein the molecular weight distribution ($M_w/M_n$) is, for example, from about 1.5 to about 6, and more specifically, from about 2 to about 4.

Examples of crystalline polyester resins are, for example, poly(ethylene-adipate), poly(propylene-adipate), poly(butylene-adipate), poly(pentylene-adipate), poly(hexylene-adipate), poly(octylene-adipate), poly(nonylene-adipate), poly (decylene-adipate), poly(undecylene-adipate), poly (ododecylene-adipate), poly(ethylene-glutarate), poly (propylene-glutarate), poly(butylene-glutarate), poly (pentylene-glutarate), poly(hexylene-glutarate), poly (octylene-glutarate), poly(nonylene-glutarate), poly (decylene-glutarate), poly(undecylene-glutarate), poly (ododecylene-glutarate), poly(ethylene-succinate), poly (propylene-succinate), poly(butylene-succinate), poly (pentylene-succinate), poly(hexylene-succinate), poly (octylene-succinate), poly(nonylene-succinate), poly (decylene-succinate), poly(undecylene-succinate), poly (ododecylene-succinate), poly(ethylene-pimelate), poly (propylene-pimelate), poly(butylene-pimelate), poly (pentylene-pimelate), poly(hexylene-pimelate), poly (octylene-pimelate), poly(nonylene-pimelate), poly (decylene-pimelate), poly(undecylene-pimelate), poly (ododecylene-pimelate), poly(ethylene-sebacate), poly (propylene-sebacate), poly(butylene-sebacate), poly (pentylene-sebacate), poly(hexylene-sebacate), poly (octylene-sebacate), poly(nonylene-sebacate), poly (decylene-sebacate), poly(undecylene-sebacate), poly (ododecylene-sebacate), poly(ethylene-azelate), poly (propylene-azelate), poly(butylene-azelate), poly(pentylene-azelate), poly(hexylene-azelate), poly(octylene-azelate), poly(nonylene-azelate), poly(decylene-azelate), poly(undecylene-azelate), poly(ododecylene-azelate), poly(ethylene-dodecanoate), poly(propylene-dodecanoate), poly(butylene-dodecanoate), poly(pentylene-dodecanoate), poly(hexylene-dodecanoate), poly(octylene-dodecanoate), poly(nonylene-dodecanoate), poly(decylene-dodecanoate), poly (undecylene-dodecanoate), poly(ododecylene-dodecanoate), poly(ethylene-fumarate), poly(propylene-fumarate), poly (butylene-fumarate), poly(pentylene-fumarate), poly(hexylene-fumarate), poly(octylene-fumarate), poly(nonylene-fumarate), poly(decylene-fumarate), poly(undecylene-fumarate), poly(ododecylene-fumarate), copoly-(butylene-fumarate)-copoly-(hexylene-fumarate), copoly-(ethylene-dodecanoate)-copoly-(ethylene-fumarate), mixtures thereof, and the like. The crystalline resin may be derived from monomers selected from, for example, organic diols and diacids in the presence of a polycondensation catalyst.

The crystalline resin may be, for example, present in an amount of from about 5 to about 50 percent by weight of the toner, and from about 5 to about 30 percent by weight of the toner.

The crystalline resin can possess a melting point of, for example, from at least about 60° C. (degrees Centigrade throughout), or for example, from about 70° C. to about 80° C., and a number average molecular weight ($M_n$), as measured by gel permeation chromatography (GPC) of, for example, from about 1,000 to about 50,000, or from about 2,000 to about 25,000, with a weight average molecular weight ($M_w$) of, for example, from about 2,000 to about 100,000, or from about 3,000 to about 80,000, as determined by GPC using polystyrene standards. The molecular weight distribution ($M_w/M_n$) of the crystalline resin is, for example, from about 2 to about 6, and more specifically, from about 2 to about 4.

The crystalline resin may be prepared by a polycondensation process involving reacting an organic diol and an organic diacid in the presence of a polycondensation catalyst. Generally, a stochiometric equimolar ratio of organic diol and organic diacid is utilized. However, in some instances wherein the boiling point of the organic diol is from about 180° C. to about 230° C., an excess amount of diol can be utilized and removed during the polycondensation process. Additional amounts of acid may be used to obtain a high acid number for the resin, for example an excess of diacid monomer or anhydride may be used. The amount of catalyst utilized varies, and can be selected in an amount, for example, of from about 0.01 to about 1 mole percent of the resin. Additionally, in place of an organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like. The aliphatic diol is, for example, selected in an amount of from about 45 to about 50 mole percent of the crystalline resin, or in an amount of from about 1 to about 10 mole percent of the polyester resin.

Examples of organic diacids or diesters selected for the preparation of the crystalline resins include oxalic acid, fumaric, succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, and a diester or anhydride thereof.

Polycondensation catalyst examples for the preparation crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Also, in embodiments, the process for the preparation of the resin emulsion particles from amorphous or crystalline polyester resin may be generated by the solvent flash process when the resin emulsion particles may be formed by dissolving the polyester resin in an organic solvent, neutralizing the acid groups of the polyester resin with an alkali base, dispersing the resulting components with mixing in water, followed by heating to remove the organic solvent, thereby resulting in a latex emulsion. The emulsion including seed particulates of the polyester can possess average diameter size of, for example, from about 10 to about 500 nanometers, from about 10 nanometers to about 400 nanometers, or from about 50 nanometers to about 250 nanometers. In embodiments, the polyester resin may be dissolved in an organic solvent and neutralized with an alkali base, heated to about 60° C., and homogenized at 2,000 rpm to 4,000 rpm for 30 minutes, followed by distillation to remove the organic solvent.

Any suitable organic solvent may be used to dissolve the polyester resin, for example, including alcohols, esters, ethers, ketones and amines, such as ethyl acetate in an amount of, for example, about 1 weight percent to about 25 weight percent, such as about 10 weight percent resin to solvent weight ratio.

The acid groups of the polyester resin may be neutralized with an alkali base. Suitable alkali bases include, for example, sodium hydroxide, potassium hydroxide, lithium hydroxide, ammonium hydroxide, sodium bicarbonate, sodium carbonate, lithium carbonate, lithium bicarbonate, potassium bicarbonate, and potassium carbonate. The alkali base is selected in an amount to fully neutralize the acid. Complete neutralization is accomplished by measuring the pH of the emulsion, for example pH of about 7. In embodiments, the polyester resin be emulsified in water without surfactant, for example by utilizing an alkali base such as sodium hydroxide. The carboxylic acid groups of the polyester are ionized to the sodium (or other metal ion) salt and self stabilize when prepared by a solvent flash process. In other embodiments, an anionic surfactant may be added to control the particle size of the emulsion.

Examples of anionic surfactants that can be selected for the toner processes illustrated herein include, for example, sodium dodecylsulfate (SDS), sodium dodecylbenzene sulfonate, sodium dodecyinaphthalene sulfate, dialkyl benzenealkyl, sulfates and sulfonates, adipic acid, available from Aldrich, NEOGEN RK™, NEOGEN SC™ available from Kao, Tayca Power, and the like.

In embodiments, the process may include the use of a coagulant in an amount of from about 0.1 to about 2 percent by weight of the toner, and more specifically, from about 0.1 to about 1 percent by weight. In embodiments, the coagulant may be an inorganic coagulant like, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, other metal halides including monovalant and divalent halides. The coagulant may be present in the emulsion in an amount of from, for example, from about 0 to about 10 percent by weight, or from about 0.05 to about 5 percent by weight of total solids in the toner. The coagulant may also contain minor amounts of other components, for example nitric acid.

A questering agent, such as the sodium salt of ethylenediamine-tetractic acid, may optionally be introduced to sequester or extract a metal complexing ion, such as aluminum, from the coagulant during the emulsion aggregation process.

Suitable examples of waxes include those selected from vegetable waxes, natural animal waxes, mineral waxes, synthetic waxes and functionalized waxes. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax, acrylate wax, fatty acid amide wax, silicone wax, polytetrafluoroethylene wax, polyethylene wax, polypropylene wax, and mixtures thereof.

Examples of waxes in embodiments include polypropylenes and polyethylenes commercially available from Allied Chemical and Baker Petrolite, wax emulsions available from Michelman Inc. and the Daniels Products Company, EPOLENE™ N-15 commercially available from Eastman Chemical Products, Inc., VISCOL™ 550 P, a low weight average molecular weight polypropylene available from Sanyo Kasei K.K., and similar materials; alkanes such as polypropylene, polyethylene, reference U.S. Pat. Nos. 5,023,158; 5,004,666; 4,997,739; 4,988,598; 4,921,771; and 4,917,982; and U.K. Patent 1,442,835, the disclosures of which are totally incorporated herein by reference, and the like. Many of the waxes selected are hydrophobic and essentially water insoluble. The waxes are usually of a weight average molecular weight of from about 300 to about 20,000, from about 1,000 to about 12,000, from about 500 to about 2,500, or from about 700 to about 1,500. Mixtures of waxes can also be selected, such as a mixture of low molecular weight waxes of, for example, polypropylene and polyethylene, where low refers, for example, to a weight average molecular weight of from about 500 to about 8,000. The commercially available polyethylenes selected have a number average molecular weight of from about 1,000 to about 2,500, while the commercially available polypropylenes utilized for the toner compositions disclosed herein are believed to have a number average molecular weight of from about 4,000 to about 5,000. Examples of functionalized waxes, such as amines and amides, include, for example AQUA SUPERSLIP™ 6550, SUPERSLIP™ 6530 available from Micro Powder Inc., fluorinated waxes, for example POLYFLUO™ 190, POLYFLUO™ 200, POLYFLUO™ 523XF, AQUA POLYFLUO™ 411, AQUA POLYSILK™ 19, POLYSILK™ 14 available from Micro Powder Inc., mixed fluorinated amide waxes, for example MICROSPERSION™ 19 also available from Micro Powder Inc., imides, esters, quaternary amines, carboxylic acids or acrylic polymer emulsion, for example JONCRYL™ 74, 89, 130, 537, and 538, all available from SC Johnson Wax, chlorinated polypropylenes and polyethylenes commercially available from Allied Chemical and Petrolite Corporation and SC Johnson wax.

Examples of functionalized waxes include amines, amides, imides, esters, quaternary amines, carboxylic acids or acrylic polymer emulsion, for example JONCRYL™ 74, 89, 130, 537, and 538, all available from Johnson Diversey, Inc., chlorinated polypropylenes and polyethylenes commercially available from Allied Chemical and Petrolite Corporation and Johnson Diversey, Inc. A number of the polyethylene and polypropylene compositions are illustrated in British Patent 1,442,835, the disclosure of which is totally incorporated herein by reference.

Various known colorants, especially pigments, present in the toner in an effective amount of, for example, from about 1 to about 65, more specifically from about 2 to about 35 percent by weight of the toner, and yet more specifically in an amount of from about 1 to about 15 weight percent, include carbon black like REGAL® 330; and magnetites, such as Mobay magnetites MO8029™, MO8060™; and the like. As colored pigments, there can be selected known cyan, magenta, yellow, red, green, brown, blue, or mixtures thereof. Specific examples of colorants, especially pigments, include phthalocyanine HELIOGEN BLUE™ L6900, D6840, D7080, D7020, Cyan 15:3, Magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of specific cyans that may be selected include copper tetra(octadecyl sulfonamide)phthalocyanine, x copper phthalocyanine pigment listed in the Color Index as Cl 74160, Cl Pigment Blue, and Anthrathrene Blue, identified in the Color Index as Cl 69810, Special Blue X 2137, and the like; while illustrative specific examples of yellows that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5 dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The colorants, such as pigments, selected can be flushed pigments as indicated herein and not dry pigments.

More specifically, colorant examples include Pigment Blue 15:3 having a Color Index Constitution Number of 74160, magenta pigment Red 81:3 having a Color Index Constitution Number of 45160:3, and Yellow 17 having a Color Index Constitution Number of 21105. Colorants include pigments, dyes, mixtures of pigments, mixtures of dyes, and mixtures of dyes and pigments, and the like. The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrate a toner with a distearyl dimethyl ammonium methyl sulfate charge additive, the disclosures of which are totally incorporated herein by reference, negative charge enhancing additives like aluminum complexes, and the like.

Surface additives that can be added to the toner compositions after washing or drying include, for example, metal salts, metal salts of fatty acids, colloidal silicas, metal oxides like titanium, tin, and the like, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL® R972 available from Degussa Chemicals, or silicas available from Cabot Corporation or Degussa Chemicals, each in amounts of from about 0.1 to about 2 percent, which can be added during the aggregation process or blended into the formed toner product.

Developer compositions can be prepared by mixing the toners obtained with the processes disclosed herein with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners disclosed herein, reference for example a number of the patents mentioned herein, and U.S. Pat. Nos. 4,265,990; 4,858,884; 4,584,253 and 4,563,408, the disclosures of which are totally incorporated herein by reference.

The following Examples are provided. Parts and percentages are by weight and temperatures are in degrees Centigrade, unless otherwise indicated.

EXAMPLE I

Preparation of Amorphous Polyester Resin Particle Emulsion 816.67 Grams of ethyl acetate were added to 125 grams of a propoxylated bisphenol A fumarate resin, available as Resapol from Reichold Chemicals, with a glass transition temperature of about 56.7° C., and acid number of 17 meq/KOH. The resin was dissolved by heating in a solvent to 65° C. on a hot plate and stirring at about 200 rpm. In a separate 4 liter glass reactor vessel were added 3.05 grams, acid number of approximately 17 meq/KOH, of sodium bicarbonate and 708.33 grams of deionized water. The resulting aqueous solution was heated to 65° C. on a hot plate with stirring at about 200 rpm. The dissolved resin in the ethyl acetate mixture was slowly poured into the 4 liter glass reactor containing the aqueous solution with homogenization at 4,000 rpm. The homogenizer speed was then increased to 10,000 rpm for about 30 minutes. The homogenized mixture resulting was placed in a heat jacketed Pyrex distillation apparatus with stirring at about 200 rpm. The temperature was increased to 80° C. at about 1° C./minute. The ethyl acetate was distilled from the mixture at 80° C. for 120 minutes. The mixture attained was then cooled to below 40° C. then screened through a 20 micron screen. The mixture was pH adjusted to 7 using a 4 weight percent NaOH aqueous solution and centrifuged. The resulting resin was comprised of 20 weight percent solids by weight in water with a volume average diameter of about 180 nanometers as measured with a Honeywell UPA150 particle size analyzer.

EXAMPLE II

Preparation of the Crystalline Polyester Resin, Copoly(ethylene-dodecanoate)-copoly-(ethylene-fumarate), Derived from Dodecanedioic Acid, Ethylene Glycol and Fumaric Acid A one liter Parr reactor equipped with a heating mantle, mechanical stirrer, bottom drain valve, and distillation apparatus was charged with dodecanedioic acid (443.6 grams), fumaric acid (18.6 grams), hydroquinone (0.2 gram), n-butylstannoic acid (FASCAT 4100) catalyst (0.7 gram), and ethylene glycol (248 grams). The materials were stirred and slowly heated to 150° C. over 1 hour under a stream of $CO_2$. The temperature was then increased by 15° C., and subsequently at 10° C. intervals, every 30 minutes, to 180° C. During this time, water was distilled as a byproduct. The temperature was then increased by 5° C. intervals, over a 1 hour period, to 195° C. The pressure was then reduced to 0.03 mbar over a 2 hour period, and any excess glycols were collected in the distillation receiver. The resin was returned to atmospheric pressure under a stream of $CO_2$, and then trimellitic anhydride (12.3 grams) was added. The pressure was slowly reduced to 0.03 mbar over 10 minutes, and held there for another 40 minutes. The obtained crystalline resin, copoly (ethylene-dodecanoate)-copoly-(ethylene-fumarate), was returned to atmospheric pressure, and then drained through the bottom drain valve to give a resin with a viscosity of 87 Pa·s (measured at 85° C.), an onset melting of 69° C., melt point temperature peak of 78° C., and recrystallization peak on cooling of 56° C. as measured by the DuPont Differential Scanning Calorimeter. The acid value of the resin was found to be 12 meq/KOH.

EXAMPLE III

Preparation of Crystalline Resin Emulsion 816.67 Grams of ethyl acetate were added to 125 grams of the above prepared Example II copoly(ethylene-dodecanoate)-copoly-(ethylene-fumarate)crystalline resin. This resin was dissolved in a suitable solvent by heating to 65° C. on a hot plate and stirring at about 200 rpm. In a separate 4 liter glass reactor vessel were added 4.3 grams of a Tayca Power surfactant (47 weight percent aqueous solution), 2.2 grams, acid number of approximately 12 meq/KOH, of sodium bicarbonate and 708.33 grams of deionized water. This aqueous solution was heated to 65° C. on a hot plate with stirring at about 200 rpm. The dissolved resin in the ethyl acetate mixture was slowly poured into the 4 liter glass reactor containing the above aqueous solution with homogenization at 4,000 rpm. The homogenizer speed was then increased to 10,000 rpm and left for 30 minutes. The homogenized mixture was placed in a heat jacketed Pyrex distillation apparatus with stirring at about 200 rpm. The temperature was then increased to 80° C. at about 1° C./minute, and the ethyl acetate was distilled from the mixture at 80° C. for 120 minutes. The mixture attained was cooled to below 40° C. then screened through a 20 micron screen, and the pH was adjusted to 7 using a 4 weight percent NaOH aqueous solution and centrifuged. The resulting resin was comprised of 21 weight percent solids by weight in water with a volume average diameter of about 203 nanometers as measured with a Honeywell UPA150 particle size analyzer.

EXAMPLES IV TO XII

General procedure for the preparation of cyan toners comprised of 84.2 percent by weight of the amorphous resin of Example I, 12 percent by weight of the crystalline resin of Example III, 3.9 percent by weight of Pigment Blue 15:3, and utilizing various amounts of aluminum sulfate as the coagulant, and varying the temperature and pH during coalescence as illustrated in Table A.

A 2 liter kettle was charged with 420 grams of the amorphous polyester emulsion of Example I above, 57.3 grams of the crystalline emulsion of Example III, 302 grams of water, 24.4 grams of Cyan Pigment Blue 15:2 dispersion (17 percent solids available from Sun Chemicals), and 4.1 grams of DOWFAX® surfactant (47.5 percent aqueous solution), and the mixture was stirred at 100 rpm. To this mixture were then added 65 grams of 0.3 N nitric acid solution until a pH of about 3.7 was achieved, followed by homogenizing at 2,000 rpm, followed by the addition of aluminum sulfate (see Table A for amounts), and the homogenizer speed was increased to 4,200 rpm at the end of the aluminum sulfate addition, resulting in a pH for the mixture of 3.1. The mixture was then stirred at 200 to 300 rpm with an overhead stirrer and placed in a heating mantle. The temperature was increased to 47.5° C. over a 30 minute period, during which the particles grew to about 7 microns volume average diameter. A solution comprised of sodium hydroxide in water (about 4 weight percent by weight of NaOH) was added to freeze the size (prevent further growth) until the pH of the mixture was about 6.8. During this addition, the stirrer speed was reduced to about 150 rpm, the mixture was then heated to 63° C. over 60 minutes, after which the pH was maintained at about 6.6 to about 6.8 with dropwise addition of an aqueous solution of sodium hydroxide (4 weight percent by weight). Subsequently, the mixture was heated to coalescence at a final temperature and pH as illustrated in Table A. The resulting toner particles were comprised of 84.2 percent by weight of the amorphous resin of Example I, 12 percent by weight of the crystalline resin of Example III, and 3.9 percent by weight of Pigment Blue 15:3, and were coalesced until the desired circularity of about 0.96 was obtained, as measured by SYSMEX FPIA-2100 flow-type histogram analyzer.

TABLE A

| Toner | Aluminum Sulfate (Parts per Hundred) | Coalescence Temperature ° C. | pH of Coalescence |
|---|---|---|---|
| Example IV | 0.3 | 66 | 5.8 |
| Example VI | 0.3 | 68 | 6.0 |
| Example VII | 0.3 | 70 | 6.3 |
| Example VIII | 0.3 | 74 | 6.8 |
| Example IX | 0.2 | 66 | 5.8 |
| Example X | 0.2 | 68 | 6.0 |
| Example XI | 0.2 | 70 | 6.3 |
| Example XII | 0.2 | 74 | 6.8 |

Heat Cohesion Measurement:

Five grams of toner were placed into an open dish and conditioned in an environmental chamber at 55° C. and 50 weight percent relative humidity. After 24 hours, the samples were removed and acclimated in ambient conditions for 30 minutes. Each re-acclimated sample was then poured into a stack of two preweighed mesh sieves, which were stacked as follows, 1,000 μm on top and 106 μm on bottom. The sieves were vibrated for 90 seconds at 1 millimeter amplitude with a Hosokawa flow tester. After the vibration was completed, the sieves were reweighed and toner heat cohesion was calculated from the total amount of toner remaining on both sieves as a percentage of the starting weight.

Glass Transition Temperature:

Utilizing a DuPont differential scanning calorimeter with a temperature ramp of 10° C. per minute, the onset of the transition was measured.

Measurement of Tribocharge and Relative Humidity Sensitivity (RH):

Developer samples were prepared in a 60 milliliter glass bottle by weighing 0.5 gram of toner onto 10 grams of carrier comprised of a steel core and a coating of a polymer mixture of polymethylmethacrylate(PMMA, 60 weight percent) and polyvinylidene fluoride (40 weight percent). Developer samples were prepared in duplicate as above for each toner that was being evaluated. One sample of the pair was conditioned in the A-zone environment of 28° C./85 weight percent RH, and the other was conditioned in the C-zone environment of 10° C./15 weight percent RH. The samples were kept in the respective environments overnight, about 18 to about 21 hours, to fully equilibrate. The following day, the developer samples were mixed for 1 hour using a Turbula mixer, after which the charge on the toner particles was measured using a charge spectrograph. The toner charge was calculated as the midpoint of the toner charge distribution. The charge was in millimeters of displacement from the zero line for both the parent particles and particles with additives. The relative humidity (RH) ratio was calculated as the A-zone charge at 85 weight percent humidity (in millimeters) over the C-zone charge at 15 weight percent humidity (in millimeters).

The toner glass transition temperature (onset), heat cohesion, both A and C zone tribocharge, and RH sensitivity are listed in Table B.

TABLE B

| | | | Tribocharge | | |
|---|---|---|---|---|---|
| Toner | Tg (° C.) | Heat Cohesion (%) | A-Zone | C-Zone | RH |
| Example IV | 56.7 | 7.5 | 6.8 | 13.0 | 0.52 |
| Example VI | 54.2 | 21 | 6.5 | 12.8 | 0.51 |
| Example VII | 48.8 | 78 | 4.5 | 12.8 | 0.35 |
| Example VIII | 46.3 | 100 | 3.1 | 11.0 | 0.28 |
| Example IX | 57.2 | 8.5 | 6.6 | 12.5 | 0.53 |
| Example X | 54.2 | 17 | 5.9 | 13.1 | 0.45 |
| Example XI | 49.1 | 85 | 4.2 | 12.0 | 0.35 |
| Example XII | 45.6 | 95 | 3.7 | 11.1 | 0.33 |

As illustrated in Table B, a lower glass transition temperature with corresponding higher (inferior) heat cohesion was obtained for toners wherein its corresponding coalescence temperature was at near or above the onset temperature of the crystalline resin (69° C.). This was a result of the plasticization of the amorphous and crystalline resin and its corresponding tribocharge, and also RH was decreased. When the coalescence temperature was below the onset melting of the crystalline resin, such as from about 66° C. to about 68° C., no depression in glass transition was observed; and low heat cohesion, and excellent tribocharge and RH sensitivity were obtained. Lowering the pH of the mixture from about 6.3 to about 5.7 during the coalescence enables the toner composite to coalesce more rapidly.

Fusing Results:

Unfused test images were made using a Xerox Corporation DC12 color copier/printer. Images were removed from the Xerox Corporation DC12 before the document passed through the fuser. These unfused test samples were then fused using a Xerox Corporation iGen3® fuser. Test samples were directed through the fuser using the Xerox Corporation iGen3® process conditions (100 prints per minute). Fuser roll temperature was varied during the experiments so that gloss and crease area could be determined as a function of the fuser roll temperature. Print gloss was measured using a BYK Gardner 75 degree gloss meter. How well toner adheres to the paper was determined by its crease fix minimum fusing temperature (MFT). The fused image was folded and an 860 gram weight of toner was rolled across the fold after which the page was unfolded and wiped to remove the fractured toner from the sheet. This sheet was then scanned using an Epson flatbed scanner and the area of toner which had been removed from the paper was determined by image analysis software such as the National Instruments IMAQ. For the toners of Examples IV to XII, the minimum fixing temperature was found to be from about 120° C. to about 130° C., the hot-offset temperature was found to be about equal to or greater than about 210° C., and the fusing latitude was about equal to or greater than about 80° C.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A toner process comprising the aggregation and coalescence of an amorphous polyester, a crystalline polyester, a colorant, and wherein said coalescence is conducted at a temperature that is lower than the onset melting point temperature of the crystalline polyester.

2. A process in accordance with claim 1 wherein said aggregation and coalescence is accomplished in the presence of a wax, and wherein said aggregation and coalescence is accomplished at a pH of from about 5.7 to about 6.3.

3. A process in accordance with claim 1 wherein said aggregation and coalescence is accomplished in the presence of a wax.

4. A process in accordance with claim 3 wherein said generating of the emulsion of amorphous and crystalline polyester resin particles is accomplished by a solvent flash process or a phase inversion process.

5. A process in accordance with claim 4 wherein said solvent flash process comprises dissolving said polyester resin in a low boiling organic solvent, and wherein low is from about 30° C. to about 85° C., which solvent is immiscible with water, and adding the resulting solution to an aqueous solution comprised of an alkaline base of at least one of sodium hydroxide and ammonia with homogenization at from about 1,000 to about 10,000 revolutions per minute for a duration of from about 1 minute to about 30 minutes, followed by distillation with stirring of the organic solvent to afford the resin emulsion particles with a solids in water content of from about 5 to about 70 percent, and with an average diameter size of from about 50 to about 250 nanometers.

6. A process in accordance with claim 5 wherein said low boiling organic solvent comprises at least one of an alcohol, ester, ether, ketone, and an amine selected in an amount of from about 10 weight percent to about 60 weight percent of the polyester resin.

7. A process in accordance with claim 6 wherein said low boiling organic solvent is ethyl acetate or methyl ethyl ketone.

8. A process in accordance with claim 4 wherein said phase inversion process comprises dissolving the amorphous or crystalline polyester resin in a low boiling organic solvent immiscible in water, followed by heating to a temperature of about 25° C. to about 70° C., and adding thereto a solvent inversion agent, followed by the addition of an alkaline base and water dropwise until phase inversion occurs, followed by distillation with stirring of the organic solvent to afford the resin emulsion particles with an average diameter size of from about 120 to about 180 nanometers.

9. A process in accordance with claim 8 wherein said inversion agent is an alcohol of at least one of methanol, ethanol, propanol, butanol, pentanol, ethylene glycol, and propylene glycol selected in an amount of from about 1 weight percent to about 25 weight percent of the polyester resin.

10. A process in accordance with claim 3 comprising (i) generating an emulsion comprised of water and resin containing from about 5 to about 70 percent solids of said amorphous polyester resin particles with a particle diameter size of from about 50 to 250 nanometers;

(ii) generating an emulsion of crystalline polyester resin particles with a particle diameter size of from about 50 to about 250 nanometers;

(iii) aggregating said resulting mixture of amorphous polyester resin particles, crystalline polyester resin particles, and colorant comprised of from about 25 to about 45 weight percent solids dispersion and wax dispersion with a coagulant at a pH of from about 2.5 to about 4, which pH is achieved with a dilute acid, and shearing the resulting mixture with a homogenizer at from about 2,000 to about 10,000 rpm; and (iv) subsequently heating the mixture to a temperature of from about 40° C. to about 55° C. to thereby generate toner aggregates of from about 3 to about 9 microns in diameter; followed by freezing said aggregate size by the addition of alkaline base at a pH of from about 6.3 to about 9, and adding a metal sequestering agent; heating the resulting aggregate composite to a temperature below the onset melting point of the crystalline resin to enable coalescence; decreasing the pH of the mixture from about 5.7 to about 6.3 with an acid or buffer to coalesce the toner components; and thereafter cooling, washing, isolating, and drying the toner product.

11. A process in accordance with claim 10 wherein said acid is nitric acid or hydrochloric acid; the alkaline base is sodium hydroxide or potassium hydroxide; and said metal sequestering agent is an ethylenediamine-tetraacetic acid sodium salt.

12. A process in accordance with claim 1 wherein the colorant is at least one of a dye, a pigment, and mixtures thereof present in an amount of from about 1 to about 25 percent by weight based upon the total weight of the toner components.

13. A process in accordance with claim 1 wherein said amorphous polyester resin is poly(1,2-propylene-diethylene) terephthalate, polyethylene-terephthalate, polypropylene-terephthalate, polybutylene-terephthalate, polypentylene-terephthalate, polyhexalene-terephthalate, polyheptadene-terephthalate, polyoctalene-terephthalate, polyethylene-sebacate, polypropylene-sebacate, polybutylene-sebacate, polyethylene-adipate, polypropylene-adipate, polybutylene-adipate, polypentylene-adipate, polyhexalene-adipate polyheptadene-adipate, polyoctalene-adipate, polyethylene-glutarate, polypropylene-glutarate, polybutylene-glutarate, polypentylene-glutarate, polyhexalene-glutarate, polyheptadene-glutarate, polyoctalene-glutarate, polyethylene-pimelate, polypropylene-pimelate, polybutylene-pimelate, polypentylene-pimelate, polyhexalene-pimelate, polyheptadene-pimelate, poly(propoxylated bisphenol co-fumarate), poly (ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly (ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), or poly(1,2-propylene itaconate).

14. A process in accordance with claim 1 wherein said amorphous polyester resin is present in an amount from about 50 to about 90 percent by weight of the toner.

15. A process in accordance with claim 1 wherein said amorphous polyester possesses a number average molecular weight ($M_n$) of from about 10,000 to about 500,000, a weight average molecular weight ($M_w$) of from about 20,000 to about 600,000, and wherein the molecular weight distribution ($M_w/M_n$) is from about 1.5 to about 6.

16. A process in accordance with claim 1 wherein said crystalline polyester resin is poly(ethylene-adipate), poly(propylene-adipate), poly(butylene-adipate), poly(pentylene-adipate), poly(hexylene-adipate), poly(octylene-adipate), poly(nonylene-adipate), poly(decylene-adipate), poly(undecylene-adipate), poly(ododecylene-adipate), poly(ethylene-glutarate), poly(propylene-glutarate), poly(butylene-glutarate), poly(pentylene-glutarate), poly(hexylene-glutarate), poly(octylene-glutarate), poly(nonylene-glutarate), poly(decylene-glutarate), poly(undecylene-glutarate), poly(dododecylene-glutarate), poly(ethylene-succinate), poly(propylene-succinate), poly(butylene-succinate), poly(pentylene-succinate), poly(hexylene-succinate), poly(octylene-succinate), poly(nonylene-succinate), poly(decylene-succinate), poly(undecylene-succinate), poly(ododecylene-succinate), poly(ethylene-pimelate), poly(propylene-pimelate), poly(butylene-pimelate), poly(pentylene-pimelate), poly(hexylene-pimelate), poly(octylene-pimelate), poly(nonylene-pimelate), poly(decylene-pimelate), poly(undecylene-pimelate), poly(ododecylene-pimelate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dododecylene-sebacate), poly(ethylene-azelate), poly(propylene-azelate), poly(butylene-azelate), poly(pentylene-azelate), poly(hexylene-azelate), poly(octylene-azelate), poly(nonylene-azelate), poly(decylene-azelate), poly(undecylene-azelate), poly(ododecylene-azelate), poly(ethylene-dodecanoate), poly(propylene-dodecanoate), poly(butylene-dodecanoate), poly(pentylene-dodecanoate), poly(hexylene-dodecanoate), poly(octylene-dodecanoate), poly(nonylene-dodecanoate), poly(decylene-dodecanoate), poly(undecylene-dodecanoate), poly(ododecylene-dodecanoate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), poly(undecylene-fumarate), poly(dododecylene-fumarate), copoly-(butylene-fumarate)-copoly-(hexylene-fumarate), or copoly-(ethylene-dodecanoate)-copoly-(ethylene-fumarate).

17. A process in accordance with claim 1 wherein said crystalline polyester resin is present in an amount of from about 5 to about 25 percent by weight of the toner comprised of colorant, crystalline polyester, and amorphous polyester.

18. A process in accordance with claim 1 wherein said crystalline polyester resin possesses a melting point of from about 60° C., to about 80° C., and a number average molecular weight ($M_n$) of from about 1,000 to about 50,000, a weight average molecular weight ($M_w$) of from about 2,000 to about 100,000, and a molecular weight distribution ($M_w/M_n$) of from about 2 to about 6.

19. A process in accordance with claim 1 wherein there is further included prior to said aggregation and coalescence a wax dispersion in an amount of from about 5 weight percent to about 15 weight percent based upon the total weight of the composition comprised of colorant, crystalline polyester, wax, and amorphous polyester.

20. A process in accordance with claim 19 wherein the wax is selected from the group consisting of at least one of natural vegetable waxes, natural animal waxes, mineral waxes, synthetic waxes, and functionalized waxes.

21. A process in accordance with claim 19 wherein the wax is selected from the group consisting of at least one of carnauba wax, candelilla wax, bayberry wax, beeswax, punic wax, lanolin, lac wax, shellac wax, spermaceti wax, paraffin wax, microcrystalline wax, montan wax, ozokerite wax, ceresin wax, petrolatum wax, petroleum wax, Fischer-Tropsch wax, acrylate wax, fatty acid amide wax, silicone wax, polytetrafluoroethylene wax, polyethylene wax, and polypropylene wax.

22. A process in accordance with claim 19 wherein said wax possesses a molecular weight average ($M_w$) of from about 1,500 to about 20,000.

23. A process in accordance with claim 19 wherein said wax possesses a low molecular weight average ($M_w$) of from about 3,500 to about 10,000, or a low molecular weight average ($M_w$) of from about 4,000 to about 7,000.

24. A process in accordance with claim 1 wherein the toner is comprised of about 84.2 percent by weight of the amorphous resin, poly(propoxylated bisphenol co-fumarate, about 12 percent by weight of the crystalline resin, copoly(ethylene-dodecanoate)-copoly-(ethylene-fumarate), and about 3.9 percent by weight of colorant.

25. A process in accordance with claim 1 wherein said colorant is a pigment.

26. A process in accordance with claim 1 wherein the colorant is a dye.

27. A process in accordance with claim 1 wherein said colorant is comprised of a mixture of pigments, a mixture of dyes, or a mixture of dyes and pigments.

28. A process in accordance with claim 1 wherein there results a toner comprised of from about 75 to about 90 percent by weight of said amorphous resin, about 5 to about 25 percent by weight of said crystalline resin, about 3 to about 10 percent by weight of said colorant, and optionally further including about 6 to about 11 percent of wax, and wherein the total of all components is 100 percent.

29. A process in accordance with claim 1 wherein said amorphous polyester resin is poly(1,2-propylene-diethylene) terephthalate, poly(propoxylated bisphenol co-fumarate), or poly(co-propoxylated bisphenol co-ethoxylated bisphenol co-fumarate).

30. A process in accordance with claim 1 wherein said crystalline polyester resin is poly(octylene-succinate), poly(nonylene-dodecanoate), poly(decylene-dodecanoate), or copoly-(ethylene-dodecanoate)-copoly-(ethylene-fumarate).

31. A toner process comprising the aggregation and coalescence of an amorphous polyester, a crystalline polyester, and a colorant, and wherein said coalescence is conducted at a temperature that is lower than the onset melting point temperature of the crystalline polyester, and wherein the pH is adjusted from a value of from about 6.5 to about 7 to a value of from about 5.7 to about 6.3.

32. A process for the preparation of toner compositions comprising the mixing, aggregation and coalescence of an amorphous polyester, a crystalline polyester, a colorant, and a wax, and wherein said coalescence is conducted at a temperature that is about equal to or less than the onset melting point temperature of the crystalline polyester.

* * * * *